US005715752A

United States Patent [19]

Rother et al.

[11] Patent Number: 5,715,752

[45] Date of Patent: Feb. 10, 1998

[54] DEVICE FOR DRAWING A PRINTING PLATE ONTO THE PLATE CYLINDER OF A PRINTING MACHINE

[75] Inventors: Michael Rother, Urberach; Helmut Schild, Steinbach/Taunus, both of Germany

[73] Assignee: MAN Roland Druckmaschinen AG, Germany

[21] Appl. No.: 602,955

[22] Filed: Feb. 16, 1996

[30] Foreign Application Priority Data

Feb. 18, 1995 [DE] Germany ..... 195 05 630.2

[51] Int. Cl.[6] ..... B41F 1/28

[52] U.S. Cl. ..... 101/415.1; 101/383

[58] Field of Search ..... 101/378, 382.1, 101/383, 415.1, DIG. 36

[56] References Cited

U.S. PATENT DOCUMENTS

| | | | |
|---|---|---|---|
| 5,309,835 | 5/1994 | Hartung et al. | 101/415.1 |
| 5,331,892 | 7/1994 | Seib et al. | 101/415.1 |
| 5,394,614 | 3/1995 | Lindner et al. | 101/415.1 |

FOREIGN PATENT DOCUMENTS

| | | |
|---|---|---|
| 42 14 207 C1 | 7/1993 | Germany . |
| 42 26 780 A1 | 2/1994 | Germany . |
| 42 15 969 C2 | 10/1994 | Germany . |
| 43 39 344 C1 | 3/1995 | Germany . |

*Primary Examiner*—Ren Yan

*Attorney, Agent, or Firm*—Leydig, Voit & Mayer, Ltd.

[57] ABSTRACT

A device for drawing a printing plate onto a plate cylinder of a printing machine is disclosed. In order to precisely position the folding strip relative to the printing cylinder during the drawing-on procedure, the folding strip of the device is provided with two pairs of adjustable stops. When inserting the printing plate into the clamping rail, a pair of adjustable clamping stops position the folding strip relative to the plate cylinder so that the leading edge of the printing plate is precisely aligned with the clamping rail. On the other hand, when inserting the printing plate into the tension rail, a pair of tensioning stops position the folding rail relative to the plate cylinder so that the trailing edge of the printing plate is bent to the precise angle necessary for its introduction into the tension rail.

21 Claims, 5 Drawing Sheets

DEVICE FOR DRAWING A PRINTING PLATE ONTO THE PLATE CYLINDER OF A PRINTING MACHINE

FIELD OF THE INVENTION

The present invention relates generally to printing machines, and more particularly to a device for drawing printing plates onto the plate cylinder of a rotary printing machine.

BACKGROUND OF THE INVENTION

In sheet-fed printing machines, a printing plate is drawn onto the plate cylinder by means of a tension rail and a clamping rail, each of which is arranged in an elongated channel in the plate cylinder. The clamping rail is assigned to the leading edge of the printing plate (the print start) and the tension rail is assigned to the trailing edge of the printing plate (the print end). The drawing-on operation is initiated by rotating the plate cylinder into a position such that the clamping rail receives the leading edge of the printing plate that is to be drawn onto the plate cylinder. Once the leading edge of the printing plate is secured in the clamping rail, the plate cylinder is slowly rotated until the printing plate is wrapped around the plate cylinder. The trailing edge of the printing plate is then secured in the tension rail. In order to ensure that the printing plate is drawn on properly it is very important to accurately introduce the leading and trailing edges of the printing plate into the clamping and tension rails, respectively.

German Patent Specification No. DE 4,215,969 B2 (which corresponds to U.S. Pat. No. 5,331,892) discloses an apparatus for drawing printing plates onto the plate cylinder of a printing machine. The apparatus includes an introduction rail for feeding printing plates which is mounted such that it can be moved against and away from the circumferential surface of the plate cylinder. In order to draw a new printing plate onto the plate cylinder, the plate cylinder is first rotated into a predetermined position and then the introduction rail is moved against the plate cylinder. When the introduction rail is in this position the leading edge of the new printing plate may be introduced directly into the gripping-region of the print-start clamping rail via an introduction face formed on the introduction rail. A stop is located on each end of the introduction rail for supporting the introduction rail on the bearer rings of the plate cylinder.

German Patent Specification No. DE 4,214,207 C1 (which corresponds to U.S. Pat. No. 5,309,835) discloses a printing plate changing device comprising a pressure roller with an attached actuable folding strip which is mounted such that it can be moved against and away from the circumferential surface of the plate cylinder. A new printing plate is drawn onto the plate cylinder by first fastening the leading edge of the printing plate into the clamping rail. The pressure roller is then moved against the plate cylinder and the pressure roller acts to draw the printing plate onto the plate cylinder as the plate cylinder is rotated. Once the plate cylinder reaches a predetermined position, the folding strip is actuated thereby bending the trailing edge of the printing plate around a fold such that it can be introduced into the tension rail. The folding strip is not equipped with adjustable stops. Therefore, the angle produced when the printing plate is bent by the folding strip cannot be adjusted. Since the bend angle cannot be adjusted, this device may not be suitable for use with all types of printing plates.

A printing plate changing apparatus in which the introduction rail for feeding a new printing plate is mounted directly on the folding strip that bends the trailing edge of the printing plate is known from German Patent Application P 4339344.6. In order to draw a new printing plate onto the plate cylinder, the pressure roller together with the folding strip is moved against the surface of the clamping rail corresponding to the leading edge of the printing plate. After the printing plate has been drawn around the outer surface of the plate cylinder, the folding strip is moved against the plate cylinder thereby bending the trailing end of the printing plate and introducing it into the corresponding tension rail. When the folding strip is moved against the plate cylinder it is supported either directly on the clamping rail or on the contour of the print end of the plate cylinder and its position relative to the clamping rail or the print end of the plate cylinder cannot be adjusted. Therefore, the requisite geometrical conditions for feeding a printing plate or for introducing the trailing edge of the printing plate into the tension rail have to be defined by means of the design of the components and cannot be changed to accommodate different types of plates.

OBJECTS OF THE INVENTION

A general object of the present invention is to provide a device for drawing printing plates onto the plate cylinder of a printing machine that is suitable for use with a wide variety of printing plates. More particularly, it is an object of the invention to provide a device for drawing printing plates onto the plate cylinder of a printing machine which includes a folding strip which can be adjusted relative to the plate cylinder in order to create the most favorable conditions for drawing a new printing plate onto the plate cylinder.

SUMMARY OF THE INVENTION

The present invention accomplishes these objectives and overcomes the drawbacks of the prior art by providing a device for drawing a printing plate onto a plate cylinder of a printing machine wherein the plate cylinder includes a bearer ring disposed at each of its ends and an elongated channel disposed longitudinally in its periphery. The device includes a clamping rail disposed in the elongated channel of the plate cylinder for clamping a leading edge of the printing plate to the plate cylinder. It also includes a tension rail disposed in the elongated channel of the plate cylinder for gripping a trailing edge of the printing plate and for tensioning the printing plate on the plate cylinder. A folding strip movably mounted adjacent the plate cylinder for movement relative between a disengaged position and an engaged position is also provided. Finally, the device includes means for locating the folding strip a first predetermined distance from the plate cylinder when the leading edge of the printing plate is being inserted into the clamping rail and for locating the folding strip a second predetermined distance from the plate cylinder when the trailing edge of the printing plate is being inserted into the tension rail. The locating means is adjustable to permit changes to either the first predetermined distance, the second predetermined distance, or both, in order to accommodate variations in the printing plates used with the device.

These and other features and advantages of the invention will be more readily apparent upon reading the following description of the preferred embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention as defined in the appended claims.

DESCRIPTION OF A PREFERRED EMBODIMENT

Figure 5:
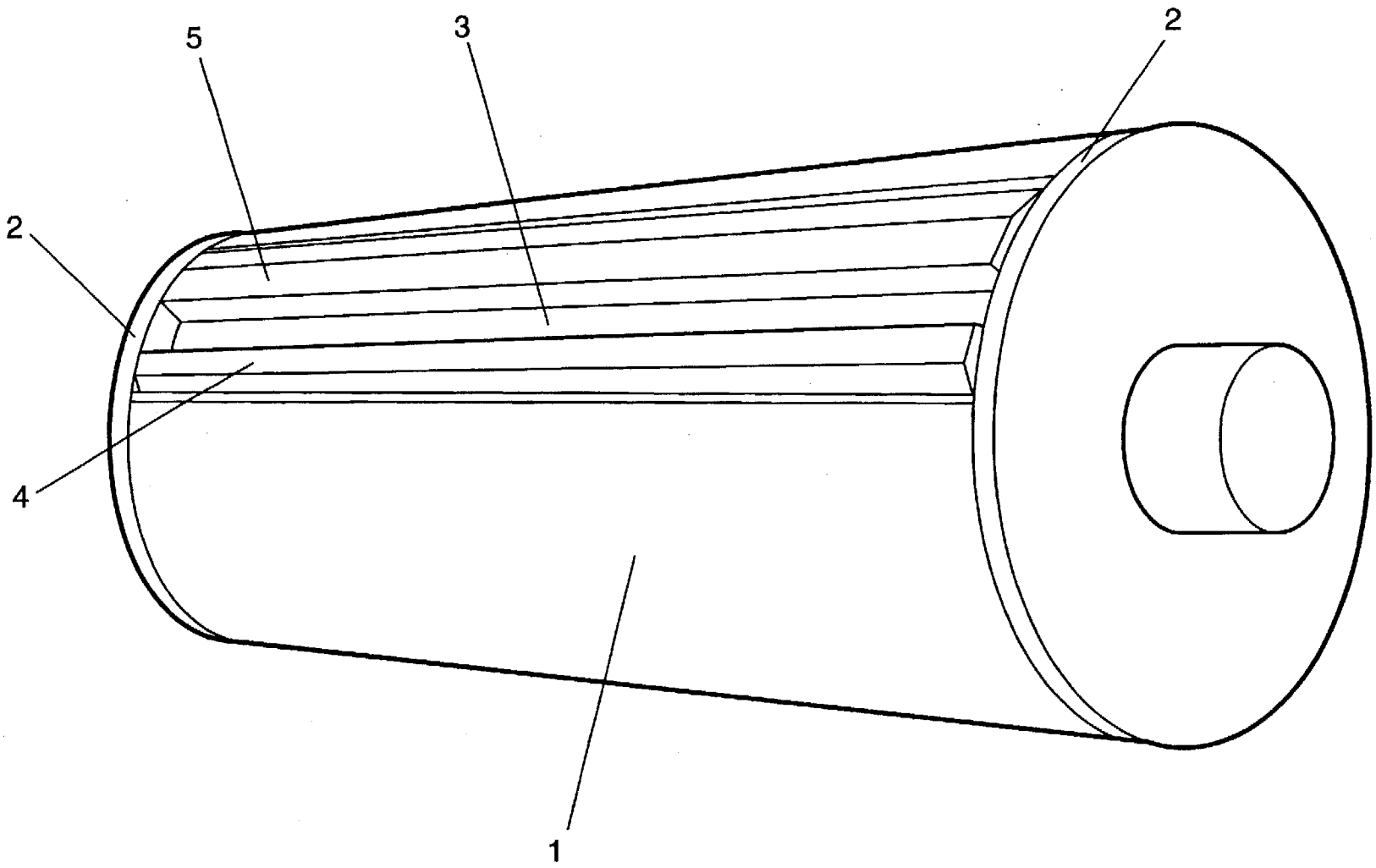
FIG. 5 is a perspective view of the plate cylinder showing the clamping and tension rails.

As shown in FIG. 5, a plate cylinder 1 typically includes a bearer ring 2 on each of its two end faces and an elongated channel 3 defined in its side. Usually, the bearer rings 2 cooperate in a known manner with corresponding rings disposed on a rubber-blanket cylinder (not shown).

In order to secure a printing plate to its side, the plate cylinder 1 is provided with a tension rail 4 and a clamping rail 5 disposed in the elongated channel 3. The clamping rail 5 is adapted to receive and fasten the leading edge of a printing plate (not shown in FIG. 5) to the plate cylinder 1. Similarly, the tension rail 4 is adapted to receive and fasten the trailing edge of the printing plate to the plate cylinder 1. Once the printing plate is securely fastened to the plate cylinder 1, the plate can be tensioned by pivoting the tension rail 4 towards the center of the plate cylinder 1.

Figure 3:
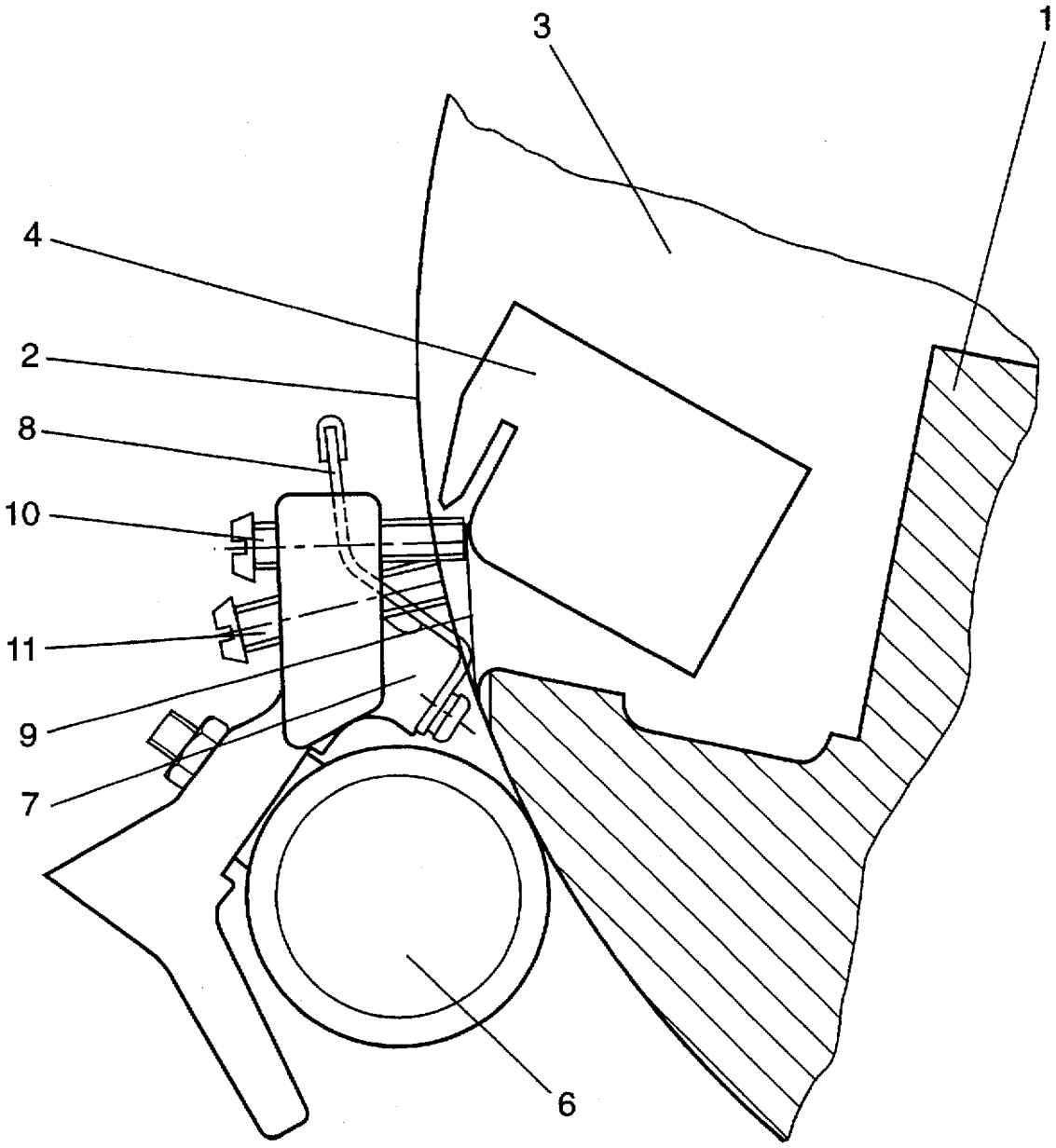
FIG. 3 is a fragmentary view showing the folding strip bending the trailing edge of the printing plate for insertion into the tension rail.
Figure 4:
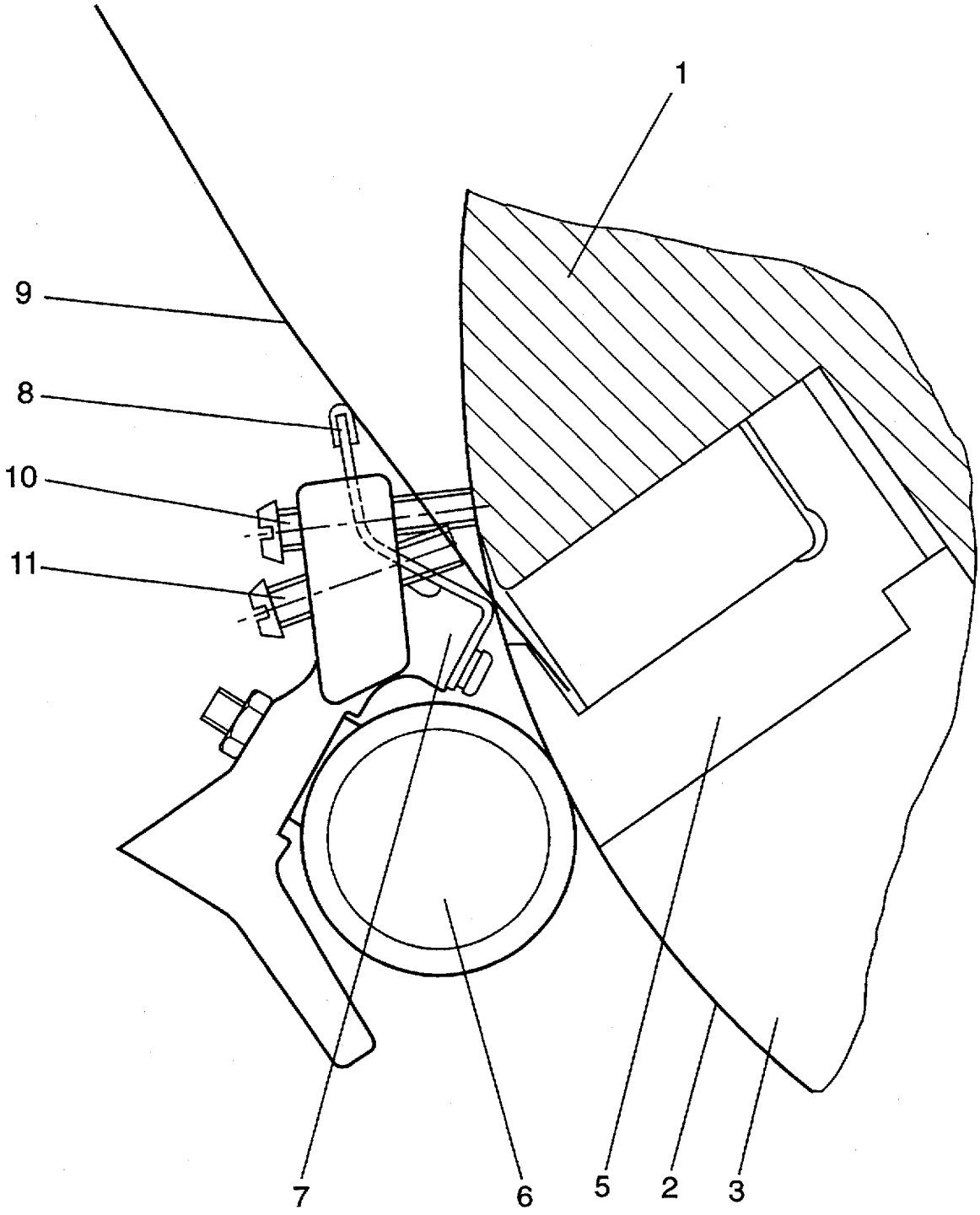
FIG. 4 is a fragmentary view similar to FIG. 3 but showing the introduction rail and the folding strip feeding the leading edge of the printing plate into the clamping rail.
Figure 6:
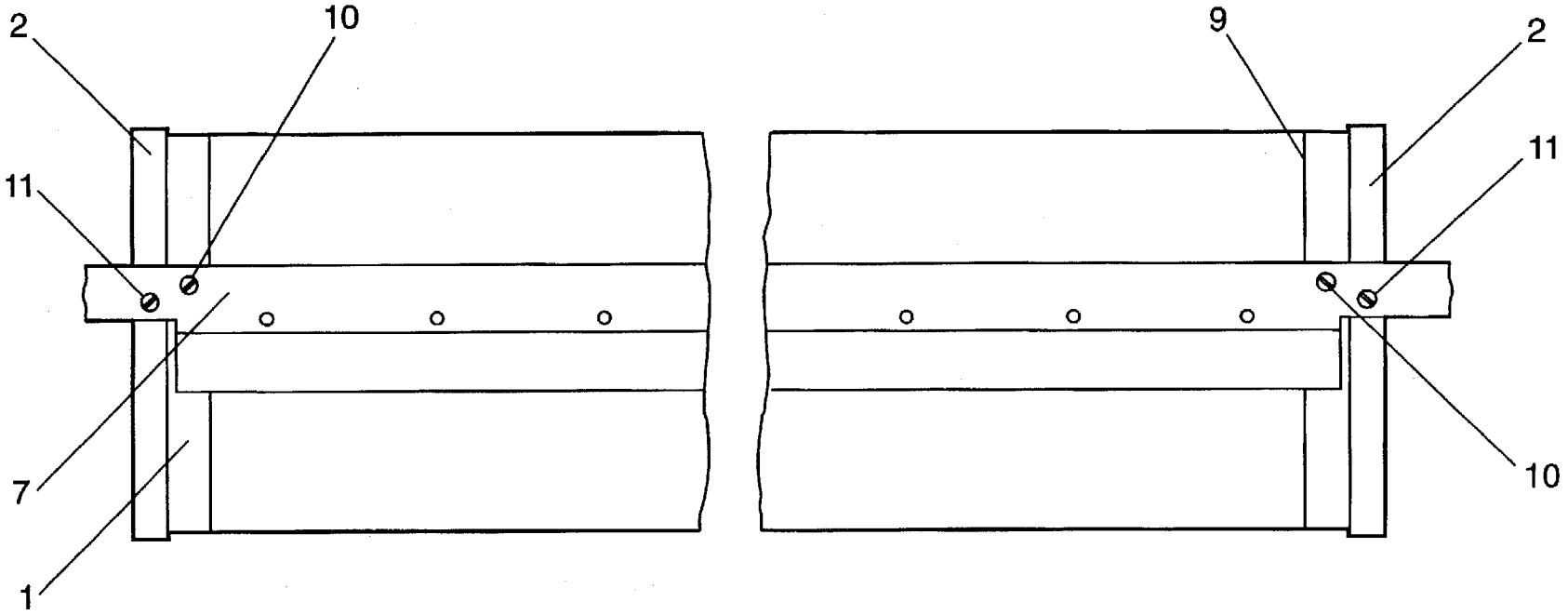
FIG. 6 is a fragmentary plan view of the plate cylinder and the folding strip.

In order to facilitate introduction of the printing plate into the tension and clamping rails 4, 5 during the drawing-on procedure, the plate cylinder 1 is provided with a pressure roller 6, a folding strip 7, and an introduction rail 8, as best shown in FIGS. 3–4. As illustrated in FIG. 6, the folding strip 7 is disposed parallel to the longitudinal axis of the plate cylinder 1 and the ends of the folding strip 7 extend beyond the bearer rings 2 of the plate cylinder 1. The folding strip 7 is mounted such that it can be engaged against and disengaged from the outer surface of the plate cylinder 1 or the bearer rings 2. The folding strip 7 can be moved between the engaged and disengaged positions by any suitable means such as, for example, bearing levers which are attached to each end of the folding strip 7 and mounted on the frame wall of the printing unit.

In accordance with an important aspect of the invention, the folding strip 7 is provided with two pairs of adjustable stops 10, 11 for precisely locating the folding strip relative to the cylinder 1 during the clamping and tensioning steps of the drawing-on procedure. More specifically, in order to facilitate introduction of the leading and trailing edges of the printing plate 9 into the tension and clamping rails 4, 5, respectively, the folding strip 7 includes a clamping stop 10 and a tensioning stop 11 at each of its ends. These stops 10, 11 serve to position the folding strip 7 in predetermined locations relative to the plate cylinder 1. Depending on the operation being performed, when the folding strip 7 is moved into the engaged position, the stops 10, 11 support the folding strip 7 on either the bearer rings 2 or the surface of the plate cylinder 1.

Figure 1:
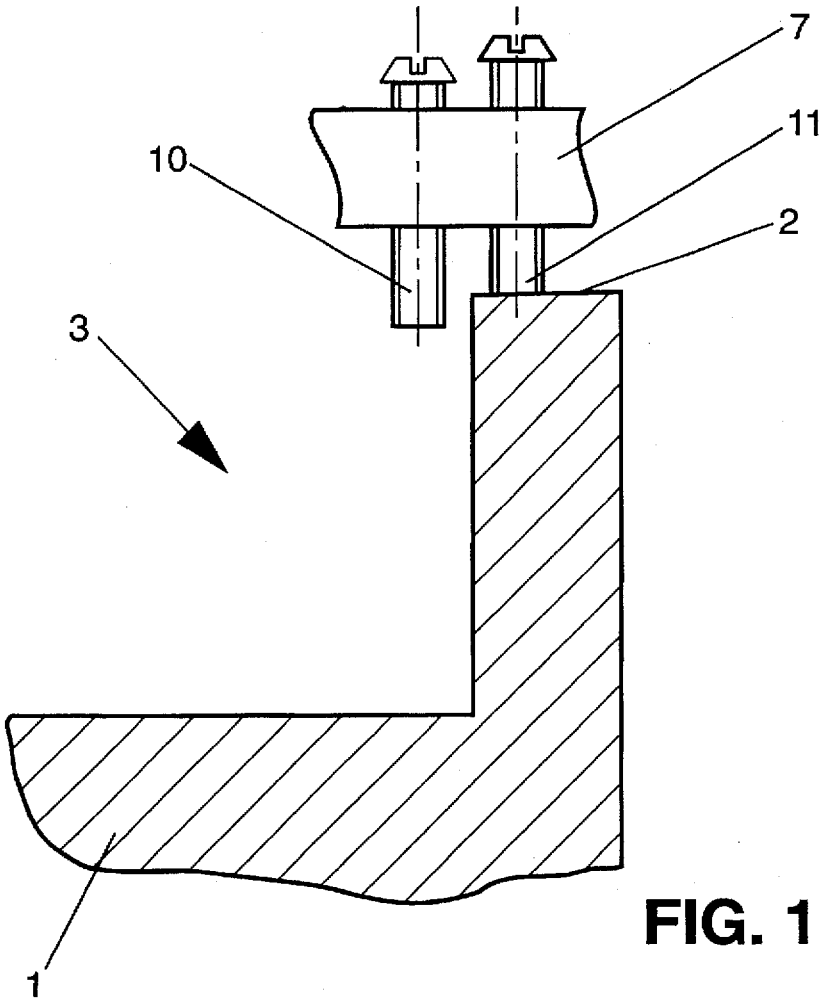
FIG. 1 is an enlarged fragmentary view of a portion of the plate changing device of the present invention showing the positions of the stops when the leading edge of the printing plate is being fed into the clamping rail of the plate cylinder.
Figure 2:
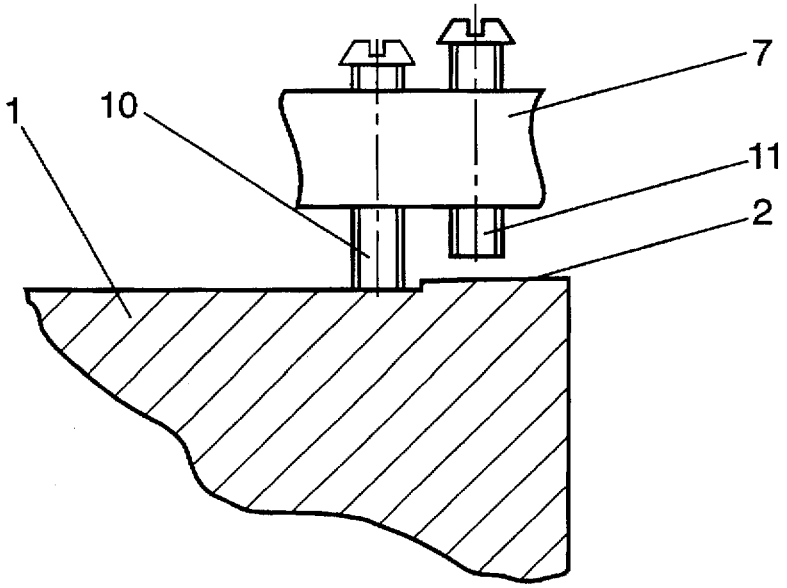
FIG. 2 is an enlarged fragmentary view similar to FIG. 1 but showing the positions of the stops when the trailing edge of the printing plate is being fed into the tension rail of the plate cylinder.

As best shown in FIGS. 1–2, the clamping stops 10 are constructed to support the folding strip 7 on the surface of the plate cylinder 1. In contrast, the tensioning stops 11 are constructed to support the strip 7 on the bearer rings 2. Therefore, the clamping stops 10 project further in the direction of the plate cylinder 1 than the tensioning stops 11 and, as explained below, the clamping stops 10 will, thus, position the folding strip 7 a different distance from the surface of the plate cylinder 1 then will the tensioning stops 11.

It should be noted that the clamping stops 10 are preferably disposed close enough to the ends of the folding strip 7 so that, when the folding strip 7 is engaged against the surface of the plate cylinder 1, the clamping stops 10 contact the cylinder 1 outside of where the largest printing plate 9 would be positioned on the cylinder 1.

For the purpose of facilitating the drawing-on of a printing plate onto the plate cylinder 1, the introduction rail 8 is mounted to the folding strip 7 which is, in turn, mounted such that it can pivot relative to the pressure cylinder 6 between the engaged and disengaged positions. To begin the drawing-on procedure, the pressure cylinder 6, which is disposed such that its rotational axis is parallel to the rotational axis of the plate cylinder 1, is first pivoted into engagement with the plate cylinder 1 as shown in FIG. 4. Next, the folding strip 7, which is disposed in advance of the pressure roller 6 with respect to the direction of rotation of the plate cylinder 1, is pivoted into engagement with the plate cylinder 1 via actuating means such as pneumatic cylinders. As shown in FIG. 4, the plate cylinder 1 is then rotated into a position wherein the clamping stops 10 engage the circumferential surface of the plate cylinder 1. As a result of the engagement between the plate cylinder 1 and the clamping stops 10, the introduction rail 8 and the folding strip 7 are positioned relative to the plate cylinder 1 such that the leading edge of the printing plate 9 can pass slidably into the clamping region of the clamping rail 5 along the side of the introduction rail 8 that faces the plate cylinder 1. As best shown in FIG. 2, since the clamping stops 10 rest on the circumferential surface of the plate cylinder 1, the tensioning stops 11 do not come into contact with the surface of the bearer rings 2 at this time.

In order to locate the folding strip 7 relative to the plate cylinder 1 to facilitate the folding and introduction of the new printing plate 9 into the tension rail 4 at the end of the drawing-on procedure, the folding strip 7 is provided with two tensioning stops 11. During this operation, the pressure roller 6 and the folding strip 7 are both engaged against the circumferential surface of the plate cylinder 1. At the same time, the clamping stops 10 extend into the elongated channel 3 of the plate cylinder and the folding strip 7 is supported on the bearer ring 2 of the plate cylinder 1 via the tensioning stops 11 such that the folding strip 7 is precisely positioned to bend the trailing edge of the printing plate 9 into the tension rail 4.

In accordance with an important aspect of the invention, the clamping and tensioning stops 10, 11 are adjustable. As a result, it is possible to precisely position the folding strip 7 and the introduction rail 8 relative to the plate cylinder 1 to accommodate differences in the printing plates applied to the plate cylinder 1. In particular, the clamping stops 10 can be adjusted to ensure that the folding strip 7 and the introduction rail 8 are precisely aligned with the gripping region of the clamping rail 5 thereby ensuring that the leading edge of a new printing plate 9 will be exactly aligned with the plate cylinder 1. Similarly, the tensioning stops 11 can be adjusted to ensure that the folding strip 7 and the pressure roller 6 bend the trailing edge of the printing plate 9 to the precise angle necessary to introduce the trailing edge of the printing plate 9 into the tension rail 4. In the illustrated embodiment, the stops 10, 11 comprise screws which are screwed through corresponding threaded bores formed in the folding strip 7 as shown in FIGS. 1–2.

In a further embodiment, the clamping and tensioning stops 10, 11 may be constructed from a material that ensures that the action of the stops 10, 11 does not damage either the plate cylinder 1 or the bearer rings 2. In addition, supporting faces may optionally be provided on the plate cylinder 1 adjacent the bearer rings 2 in order to prevent the clamping stops 10 from damaging the plate cylinder. These supporting faces could also be mounted to the faces of the bearer rings 2 to similarly protect the bearer rings 2 from damage.

Although the invention has been described in connection with certain embodiments, it will be understood that there is no intent to in any way limit the invention to those embodiments. On the contrary, the intent is to cover all alternatives, modifications and equivalents included within the spirit and scope of the invention as defined by the appended claims.

We claim:

1. A device for drawing a printing plate onto a printing machine plate cylinder having an elongated channel disposed longitudinally in its periphery comprising, a clamping rail disposed in the elongated channel of the plate cylinder for clamping a leading edge of the printing plate to the plate cylinder;

a tension rail disposed in the elongated channel of the plate cylinder for gripping a trailing edge of the printing plate and for tensioning the printing plate on the plate cylinder;

a folding strip movably mounted adjacent the plate cylinder; and, folding strip locating means having first and second cylinder contacting means that are intermittently in contact with said plate cylinder, said folding strip being located in a first predetermined distance from the plate cylinder when the first contacting means is in contact with said plate cylinder to enable the leading edge of the printing plate to be inserted into the clamping rail, said folding strip being located a second predetermined distance from the plate cylinder when said second contacting means is in contact with said plate cylinder to enable the trailing edge of the printing plate to be inserted into the tension rail, the first predetermined distance being different than the second predetermined distance.

2. A device as defined in claim 1 further comprising a pressure roller associated with the folding strip for pressing the printing plate against the plate cylinder as the plate cylinder is rotated with the leading edge of the printing plate clamped in the clamping rail.

3. A device as defined in claim 1 further comprising an introduction rail associated with the folding strip for facilitating the insertion of the trailing edge of the printing plate into the tension rail.

4. A device as defined in claim 1 wherein the second contacting means is selectively adjustable for permitting changes to the second predetermined distance in order to accommodate variations in the printing plates used with the device.

5. A device as defined in claim 4 wherein the first contacting means comprises first and second clamping stops and the second contacting means comprises first and second tensioning stops, the first clamping stop and the first tensioning stop being disposed at a first end of the folding strip and the second clamping stop and the second tensioning stop being disposed at a second end opposite the first end of the folding strip, each of the first and second tensioning stops being positioned to engage the plate cylinder to locate the folding strip relative to the printing plate when the trailing edge of the printing plate is being inserted into the tension rail, and each of the first and second clamping stops being positioned to engage the plate cylinder to locate the folding strip relative to the printing plate when the leading edge of the printing plate is being inserted into the clamping rail.

6. A device as defined in claim 5 wherein the first and second clamping stops each comprise a clamping stop screw matingly engaged in a threaded bore in the folding strip, the first and second tensioning stops each comprise a tensioning stop screw matingly engaged in a threaded bore in the folding strip, and wherein the first predetermined distance can be changed by adjusting the position of the clamping stop screws in their respective threaded bores and the second predetermined distance can be changed by adjusting the position of the tensioning stop screws in their respective threaded bores.

7. The device as defined in claim 1 in which said first and second plate cylinder contacting means are adjustable to permit changes to the first and second predetermined distances in order to accommodate variations in printing plates being drawn onto the plate cylinder.

8. A device for drawing a printing plate onto a printing machine plate cylinder having an elongated channel disposed longitudinally in its periphery comprising, a clamping rail disposed in the elongated channel of the plate cylinder for clamping a leading edge of the printing plate to the plate cylinder;

a tension rail disposed in the elongated channel of the plate cylinder for gripping a trailing edge of the printing plate and for tensioning the printing plate on the plate cylinder;

a folding strip movably mounted adjacent the plate cylinder; and, a first locating device moveable between a position in contact with said plate cylinder and a removed position out of contact with said plate cylinder, said first locating device being operable when in contact with said plate cylinder for locating the folding strip a first predetermined distance from the plate cylinder to enable the leading edge of the printing plate to be inserted into the clamping rail, and a second locating device moveable between a position in contact with said plate cylinder and a removed position out of contact with said plate cylinder, said second locating device being operable when in contact with said plate cylinder for locating the folding strip a second predetermined distance from the plate cylinder to enable the trailing edge of the printing plate to be inserted into the tension rail, the first predetermined distance being different than the second predetermined distance.

9. A device as defined in claim 8 further comprising a pressure roller associated with the folding strip for pressing the printing plate against the plate cylinder as the plate cylinder is rotated with the leading edge of the printing plate clamped in the clamping rail.

10. A device as defined in claim 8 further comprising an introduction rail associated with the folding strip for facilitating the insertion of the trailing edge of the printing plate into the tension rail.

11. A device as defined in claim 8 in which said locating devices are adjustable to permit changes in the first and second predetermined distances in order to accommodate variations in the printing plates to be drawn onto the plate cylinder.

12. A device as defined in claim 8 in which said plate cylinder includes a bearer ring at each of its opposite ends, and said second locating device is moveable into contact with one of said bearer rings.

13. A device as defined in claim 12 wherein the first locating device comprises first and second clamping stops and the second locating device comprises first and second tensioning stops, the first clamping stop and the first tensioning stop being disposed at a first end of the folding strip and the second clamping stop and the second tensioning stop being disposed at a second end opposite the first end of the folding strip, each of the first and second tensioning stops being positioned to engage one of the bearer rings of the plate cylinder to locate the folding strip relative to the printing plate when the trailing edge of the printing plate is being inserted into the tension rail, and each of the first and second clamping stops being positioned to engage the plate cylinder to locate the folding strip relative to the printing plate when the leading edge of the printing plate is being inserted into the clamping rail.

14. A device as defined in claim 13 wherein the first and second tensioning stops each comprise a tensioning stop screw matingly engaged in a threaded bore in the folding strip, and wherein the second predetermined distance can be changed by adjusting the position of the tensioning stop screws in their respective threaded bores.

15. A device for drawing a printing plate onto a plate cylinder of a printing machine, the plate cylinder including a bearer ring disposed at each of its ends and further including an elongated channel disposed longitudinally in its periphery, said device comprising, a clamping rail disposed in the elongated channel of the plate cylinder for clamping a leading edge of the printing plate to the plate cylinder;

a tension rail disposed in the elongated channel of the plate cylinder for gripping a trailing edge of the printing plate and for tensioning the printing plate on the plate cylinder;

a folding strip movably mounted adjacent the plate cylinder, the folding strip being movable between a disengaged position and an engaged position;

a first clamping stop disposed at a first end of the folding strip and a second clamping stop disposed at a second end of the folding strip, the first and second clamping stops engaging the plate cylinder to locate the folding strip a first distance from the plate cylinder to facilitate insertion of the leading edge of the printing plate into the clamping rail; and, first and second tensioning stops respectively disposed at the first and second ends of the folding strip, each of the first and second tensioning stops engaging one of the bearer rings of the plate cylinder to locate the folding strip a second distance from the plate cylinder to facilitate insertion of the trailing edge of the printing plate into the tension rail, the first distance being different from the second distance, the first and second clamping stops and the first and second tensioning stops being adjustable to permit variation of the first and second distances, respectively.

16. A device as defined in claim 15 further comprising a pressure roller associated with the folding strip for pressing the printing plate against the plate cylinder as the plate cylinder is rotated with the leading edge of the printing plate clamped in the clamping rail.

17. A device as defined in claim 15 further comprising an introduction rail associated with the folding strip for facilitating the insertion of the trailing edge of the printing plate into the tension rail.

18. A device as defined in claim 15 wherein the first and second clamping stops each comprise a clamping stop screw matingly engaged in a threaded bore in the folding strip, the first and second tensioning stops each comprise a tensioning stop screw matingly engaged in a threaded bore in the folding strip, and wherein the first distance can be changed by adjusting the position of the clamping stop screws in their respective threaded bores and the second distance can be changed by adjusting the position of the tensioning stop screws in their respective threaded bores.

19. A device for drawing a printing plate onto a plate cylinder of a printing machine, the plate cylinder including a bearer ring disposed at each of its ends and further including an elongated channel disposed longitudinally in its periphery, said device comprising, a clamping rail disposed in the elongated channel of the plate cylinder for clamping a leading edge of the printing plate to the plate cylinder;

a tension rail disposed in the elongated channel of the plate cylinder for gripping a trailing edge of the printing plate and for tensioning the printing plate on the plate cylinder;

a folding strip movably mounted adjacent the plate cylinder, the folding strip being movable relative to the plate cylinder between a disengaged position and an engaged position; and first and second clamping stops and first and second tensioning stops, the first clamping stop and the first tensioning stop being disposed at a first end of the folding strip and the second clamping stop and the second tensioning stop being disposed at a second end opposite the first end of the folding strip, each of the first and second clamping stops being positioned to engage the plate cylinder to locate the folding strip for locating the folding strip a first predetermined distance from the plate cylinder when the leading edge of the printing plate is being inserted into the clamping rail, each of the first and second tensioning stops being positioned to engage one of the bearer rings of the plate cylinder for locating the folding strip a second predetermined distance from the plate cylinder when the trailing edge of the printing plate is being inserted into the tension rail.

20. A device as defined in claim 19 wherein the first and second clamping stops each comprise a clamping stop screw matingly engaged in a threaded bore in the folding strip, and wherein the first predetermined distance can be changed by adjusting the position of the clamping stop screws in their respective threaded bores.

21. A device as defined in claim 19 in which said clamping stops and tensioning stops are adjustable to permit selected changes in the first and second predetermined distances.

* * * * *